US008622331B2

(12) United States Patent
Venter

(10) Patent No.: US 8,622,331 B2
(45) Date of Patent: Jan. 7, 2014

(54) GYRATORY CONE CRUSHER

(76) Inventor: Leon Mitchell Venter, Johannesburg (ZA)

( * ) Notice: Subject to any disclaimer, the term of this patent is extended or adjusted under 35 U.S.C. 154(b) by 0 days.

(21) Appl. No.: 13/697,772

(22) PCT Filed: Apr. 28, 2011

(86) PCT No.: PCT/ZA2011/000029

§ 371 (c)(1),
(2), (4) Date: Nov. 13, 2012

(87) PCT Pub. No.: WO2011/143677

PCT Pub. Date: Nov. 17, 2011

(65) Prior Publication Data

US 2013/0056570 A1 Mar. 7, 2013

(30) Foreign Application Priority Data

May 14, 2010 (ZA) ..... 2010/03406

(51) Int. Cl.
*B02C 2/04* (2006.01)

(52) U.S. Cl.
USPC ..... 241/207; 241/101.2; 241/208; 241/209; 241/213; 241/214; 241/215; 241/216

(58) Field of Classification Search
USPC ..... 241/101.2, 207–216
See application file for complete search history.

(56) References Cited

U.S. PATENT DOCUMENTS

| | | | | | |
|---|---|---|---|---|---|
| 3,759,453 | A * | 9/1973 | Johnson | 241/207 |
| 3,774,858 | A * | 11/1973 | Archer et al. | 241/285.1 |
| 3,834,633 | A * | 9/1974 | Dougall et al. | 241/295 |
| 4,168,036 | A * | 9/1979 | Werginz | 241/285.1 |
| 4,206,881 | A * | 6/1980 | Werginz | 241/207 |
| 5,042,732 | A * | 8/1991 | Karra et al. | 241/207 |
| 5,115,991 | A * | 5/1992 | Saari | 241/208 |
| 5,967,431 | A * | 10/1999 | Stafford et al. | 241/30 |
| 7,439,630 | B2 * | 10/2008 | Peacock | 290/1 R |
| 2006/0243839 | A9 * | 11/2006 | Barscevicius et al. | 241/261.2 |
| 2006/0278745 | A1 * | 12/2006 | Juhlin | 241/101.2 |
| 2009/0294559 | A1 * | 12/2009 | Eriksson et al. | 241/30 |
| 2011/0084156 | A1 * | 4/2011 | Martinez et al. | 241/207 |

* cited by examiner

*Primary Examiner* — Dana Ross
*Assistant Examiner* — Onekki Jolly
(74) *Attorney, Agent, or Firm* — Hahn & Moodley LLP; Vani Moodley, Esq.

(57) ABSTRACT

A gyratory cone crusher 10 includes a support frame 12 having a vertical axis X and a receiving formation 14 mounted rigidly in the frame 12, a central vertical axis of the receiving formation 14 being in line with vertical axis X. A crushing head 16 is slideably engaged with the receiving formation 14 and has a first, upwardly presented conical crushing surface 18. A crushing bowl 20 having a second, downwardly presented funnel-shaped second crushing surface 22 spaced apart from the first crushing surface 18 is mounted above the crushing head 16. The crushing bowl 20 is mounted in an eccentric housing 24 so that a central axis Z of the crushing bowl 20 is positioned at an angle oblique to vertical axis X.

11 Claims, 2 Drawing Sheets

26
24
20
30
"A"
"Z"
"X"
42
32
"Y"

GYRATORY CONE CRUSHER

FIELD OF THE INVENTION

This invention relates to crushing devices for crushing materials such as rock, building materials and ore and, more particularly, to a gyratory cone crusher.

BACKGROUND TO THE INVENTION

Various types of gyratory cone crushers are currently in use although they display inherent deficiencies. One deficiency is the drive mechanism of the crusher which includes several moving parts (e.g. a gear and pinion assembly) which is prone to wear and tear and requires regular maintenance. The spacial adjustment between the crushing surfaces is achieved by complicated mechanisms requiring regular maintenance.

The inventor therefore believes that a need exists for providing a gyratory cone crusher having fewer parts than conventional crushers, thereby alleviating at least some of the problems associated with current crushers.

SUMMARY OF THE INVENTION

According to the invention, there is provided a gyratory cone crusher including:

- a support frame having a vertical axis X;
- a receiving formation mounted rigidly in the frame, a central vertical axis of the receiving formation being in line with vertical axis X;
- a crushing head slideably engaged with the receiving formation and having a first, upwardly presented conical crushing surface;
- a crushing bowl having a second, downwardly presented funnel-shaped second crushing surface spaced apart from the first crushing surface, the crushing bowl being mounted in an eccentric housing so that a central axis Z of the crushing bowl is positioned at an angle oblique to vertical axis X;
- a flywheel mounted rotatably about vertical axis X, the flywheel including a passage having a central axis located in line with axis Z for receiving the housing therein, the housing being inhibited from rotating with the flywheel by a retaining formation; and
- a drive means for driving the flywheel; wherein rotation of the flywheel causes the housing and thereby the crushing bowl and second crushing surface to gyrate about axis Z.

The gyratory motion of the crushing bowl about axis Z is eccentric so that the crushing bowl performs a wobbling motion which results in the spacing between the first and second crushing surfaces changing continuously as the bowl gyrates.

It is to be appreciated, that the angle between axis Z and axis X may be selected during manufacture of the crusher to either accentuate or reduce the wobbling action of the crushing bowl by increasing or decreasing this angle, respectively.

The receiving formation may include a hollow cylinder in which a piston is located to be displaceable along vertical axis X to facilitate displacement of the crushing head, thereby allowing adjustment of the spacing between the first and second crushing surfaces.

The piston may be pneumatically, hydraulically or mechanically driven. In the event of the crushing surfaces being blocked by crushed material or material to be crushed which has become wedged between the crushing surfaces, the piston will automatically move downwards, thereby increasing the spacing between the crushing surfaces and allowing the material to become freed.

The first and second crushing surfaces may be defined by replaceable wear surfaces. The wear surfaces may be manufactured from any suitable material that will result in an extended life span of the wear parts during the crushing action. The wear surfaces may be manufactured from any suitable alloy steel The wear surfaces may be provided in sections. This allows quick and easy replacement of the entire wear surfaces without the need for stripping the entire apparatus.

The support frame may include releaseably connectable upper and lower portions to permit access to working parts of the crusher. The upper and lower portions may be include complementary male and female engaging formations and may in use be additionally secured by a retaining ring fitted over the engagement zone.

The retaining formation may be in the form of a torque arm connected to the eccentric housing and which may be anchored to the support frame.

The flywheel may be mounted on the upper portion of the support frame.

The flywheel may be mounted on the support frame via a low-friction mounting arrangement.

The low-friction mounting arrangement may be selected from: bearings and bushings.

The bearing may be a ball bearing, roller bearing, jewel bearing, fluid bearing, electromagnetic bearing, or flexure bearing. Alternatively, the bearing may be a plain bearing such as a bushing which may be manufactured from bronze alloy or any readily available bushing material suitable to this application.

The drive means may be an electric motor. Rotational force may be conveyed from the motor to the flywheel by means of one or more V-belts passing around a drive shaft of the drive means and an exterior surface of the flywheel or by the use of a gear, shaft and pinion assembly driving the flywheel.

A feed chute may extend from the crushing bowl for feeding material to be crushed towards the first and second crushing surfaces.

A dust cover may be mounted over the support frame. The dust cover may engage the upper portion of the support frame so as to cover the flywheel (and therewith the eccentric housing and crushing bowl) as well as the drive means and V-belts. An opening is defined in the cover for the feed chute to pass through.

DETAILED DESCRIPTION OF THE INVENTION

The invention will now be described by way of the following non-limiting example with reference to the accompanying drawings.

Figure 1:
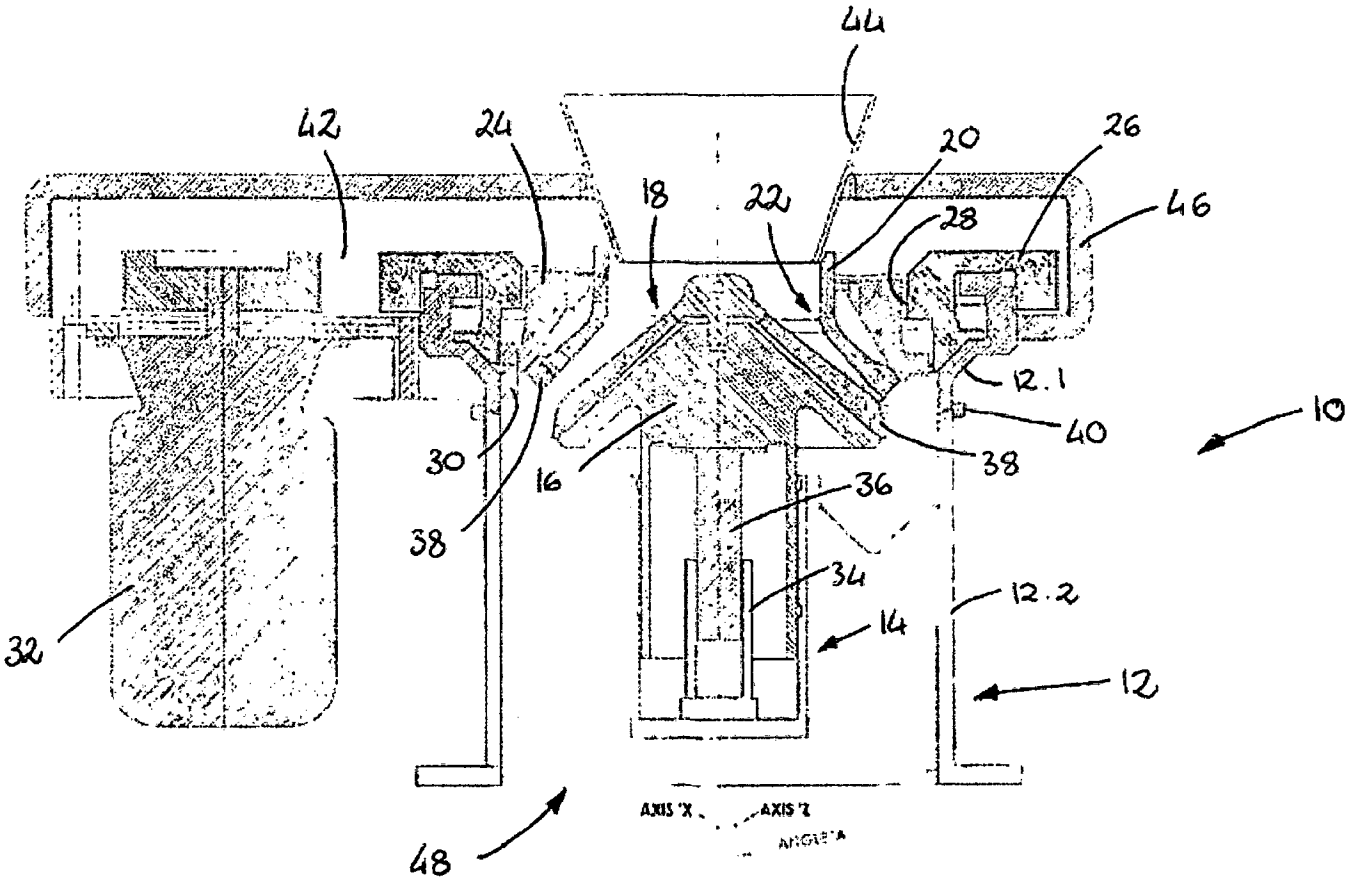
FIG. 1 shows a cross-sectional side view of a rotary cone crusher in accordance with the present invention.

In the drawings, reference numeral 10 generally indicates an embodiment of a gyratory cone crusher in accordance with the present invention.

A gyratory cone crusher 10 includes a support frame 12 having a vertical axis X and a receiving formation 14 mounted rigidly in the frame 12, a central vertical axis of the receiving formation 14 being in line with vertical axis X as shown in FIG. 1.

A crushing head 16 is slideably engaged with the receiving formation 14 and has a first, upwardly presented conical crushing surface 18.

A crushing bowl 20 having a second, downwardly presented funnel-shaped second crushing surface 22 spaced apart from the first crushing surface 18 is mounted above the crushing head 16.

The crushing bowl 20 is mounted in an eccentric housing 24 so that a central axis Z of the crushing bowl 20 is positioned at an angle oblique to vertical axis X as shown in FIG. 1.

A flywheel 26 is mounted rotatably about vertical axis X, the flywheel 26 including a passage 28 having a central axis located in line with axis Z for receiving the housing 24 therein. The housing 24 is inhibited from rotating with the flywheel 26 by a retaining formation in the form of torque arm 30 which is anchored to the support frame 12.

A drive means in the form of an electric motor 32 is provided for driving the flywheel 26.

Rotation of the flywheel 26 about axis X causes the eccentric housing 24 and thereby the crushing bowl 20 and second crushing surface 22 to gyrate about axis Z.

Figures 2, 3:
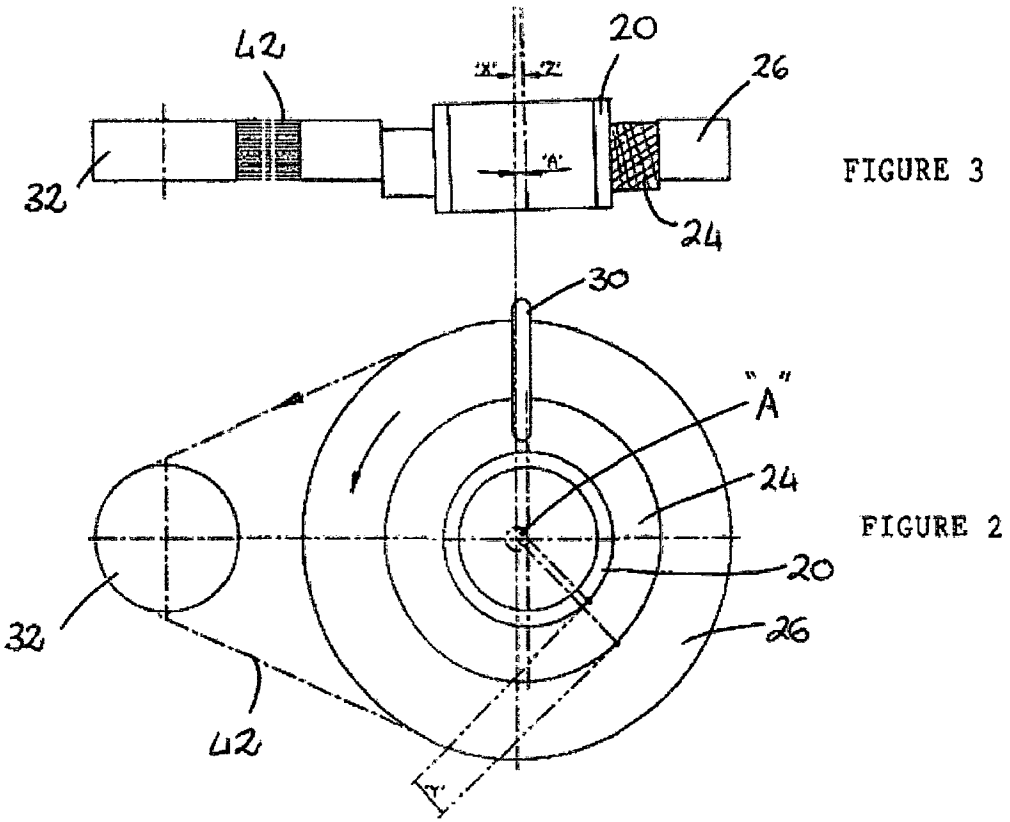
FIG. 2 shows a top plan view of a flywheel of the crusher and its drive means.
FIG. 3 shows a sectioned side view of the flywheel and crusher of FIG. 2.

The gyratory motion of the crushing bowl 20 about axis Z is eccentric so that the crushing bowl 20 performs a wobbling motion which results in the spacing between the first and second crushing surfaces 18 and 22 changing continuously as the bowl 20 gyrates along a path indicated by "A" in FIG. 2.

It is to be appreciated, that the angle between axis Z and axis X can be selected during manufacture of the crusher 10 to either accentuate or reduce the wobbling action of the crushing bowl 20 by increasing or decreasing this angle, respectively.

The receiving formation 14 includes a hollow cylinder 34 in which a piston 36 is located to be displaceable along vertical axis X to facilitate displacement of the crushing head 16, thereby allowing adjustment of the spacing between the first and second crushing surfaces 18 and 22.

The piston 36 can be pneumatically, hydraulically or mechanically driven. In the event that the crushing surfaces 18 and 22 are blocked by crushed material or material to be crushed that has become wedged between the surfaces 18 and 22, the piston 36 is moved downwards, thereby increasing the spacing between the crushing surfaces 18 and 22 and allowing the material to become freed.

The first and second crushing surfaces 18 and 22 are defined by replaceable wear surfaces 38. The wear surfaces 38 are manufactured from any suitable material that will not become significantly damaged during the crushing action such as, for example, alloy steel.

The wear surfaces 38 can be provided in sections to permit quick and easy replacement of the wear surfaces 38 without the need for stripping the entire apparatus. The worn sections of the wear surfaces 38 are small enough so that they can be dislodged and removed via a feed chute 44 of the crusher 10.

The support frame 12 includes releaseably connectable upper and lower portions 12.1 and 12.2 to permit access to working parts of the crusher 10. The upper and lower portions 12.1 and 12.2 include complementary male and female engaging formations and are in use additionally secured by a retaining ring 40 fitted over the engagement zone as shown in FIG. 1.

The flywheel 26 is mounted on the upper portion 12.1 of the support frame 12 via a low-friction mounting arrangement.

The low-friction mounting arrangement is a type of bearing, typically a bronze bushing.

Rotational force is conveyed from the motor 32 to the flywheel 26 by means of one or more V-belts 42 passing around a drive shaft of the motor 32 and an exterior surface of the flywheel 26.

The feed chute 44 extends from the crushing bowl 20 for feeding material to be crushed towards the first and second crushing surfaces 18 and 22.

A dust cover 46 is mounted over the support frame 12 and engages the upper portion 12.1 of the support frame 12 so as to cover the flywheel 26 (and therewith the eccentric housing 24 and crushing bowl 20) as well as the motor 32 and V-belts 42. An opening is defined in the cover 46 for the feed chute 44 to pass through as can be seen in FIG. 1.

The crushed material is discharged from the crusher via a material discharge opening 48.

The inventor believes that the present invention presents and improvement over currently available gyratory cone crushers due to its simple design and the use of much fewer parts than conventional crushers which leads to a reduction in production cost whilst increasing reliability and reducing maintenance time and cost.

It is to be appreciated, that the invention is not limited to any particular embodiment or configuration as herein before generally described or illustrated.

The invention claimed is:

1. A gyratory cone crusher including:

a support frame having a vertical axis X;

a receiving formation mounted rigidly in the frame, a central vertical axis of the receiving formation being in line with vertical axis X;

a non-rotary crushing head slideably engaged with the receiving formation and having a first, upwardly presented conical crushing surface;

a non-rotary crushing bowl having a second, downwardly presented funnel-shaped second crushing surface spaced apart from the first crushing surface, the crushing bowl being mounted in a housing so that a central axis Z of the crushing bowl is positioned at an angle oblique to vertical axis X;

a flywheel mounted rotatably about vertical axis X, the flywheel including a passage having a central axis located in line with axis Z for receiving the housing therein, the housing being inhibited from rotating with the flywheel by a retaining formation; and a drive means for driving the flywheel; wherein rotation of the flywheel causes the housing and thereby the crushing bowl and second crushing surface to gyrate about axis Z.

2. A crusher as claimed in claim 1, wherein the receiving formation includes a hollow cylinder in which a piston is located to be displaceable along vertical axis X to facilitate displacement of the crushing head, thereby allowing adjustment of the spacing between the first and second crushing surfaces.

3. A crusher as claimed in claim 1, wherein the first and second crushing surfaces are defined by replaceable wear surfaces.

4. A crusher as claimed in claim 3, wherein the wear surfaces are provided in sections.

5. A crusher as claimed in claim 1, wherein the support frame includes releaseably connectable upper and lower portions to permit access to working parts of the crusher.

6. A crusher as claimed in claim 5, wherein the flywheel is mounted on the upper portion of the support frame.

7. A crusher as claimed in claim 6, wherein the flywheel is mounted on the support frame via a low-friction mounting arrangement.

8. A crusher as claimed in claim 7, wherein the low-friction mounting arrangement is selected from: bearings and bushings.

9. A crusher as claimed in claim 8, wherein the drive means is an electric motor.

10. A crusher as claimed in claim 9, wherein a feed chute extends from the crushing bowl for feeding material to be crushed towards the first and second crushing surfaces.

11. A crusher as claimed in claim 10, wherein a dust cover is mounted over the support frame.

* * * * *